US005621346A

United States Patent [19]

Lopez

[11] Patent Number: 5,621,346

[45] Date of Patent: Apr. 15, 1997

[54] PROGRAMMABLE DATA MESSAGE GENERATION SYSTEM

[75] Inventor: Pablo M. Lopez, Waldorf, Md.

[73] Assignee: The United States of America as represented by the Secretary of the Navy, Washington, D.C.

[21] Appl. No.: 543,901

[22] Filed: Oct. 17, 1995

[51] Int. Cl.[6] ..... H03K 5/08

[52] U.S. Cl. ..... 327/355; 327/108; 327/333

[58] Field of Search ..... 327/108, 355, 327/333

[56] References Cited

U.S. PATENT DOCUMENTS 4,932,037 6/1990 Simpson et al. ..... 375/1
5,430,400 7/1995 Herlein et al. ..... 327/108

*Primary Examiner*—Margaret Rose Wambach
*Attorney, Agent, or Firm*—Jacob Shuster

[57] ABSTRACT

Signal messages to loads such as a missile weapon system, are transmitted as bipolar signals through high load communication lines at high voltage levels and within a wide operating frequency range. Such signal messages are based on digital data mixed by a multiplexer with computer controlled voltage level inputs and programmable frequencies to produce the bipolar signals of high voltage capable of during loads as low as 50 ohms.

8 Claims, 7 Drawing Sheets

PROGRAMMABLE DATA MESSAGE GENERATION SYSTEM

This invention relates generally to the generation of message data for computer controlled equipment.

BACKGROUND OF THE INVENTION

Portable printed circuit boards through which data input/output functions are performed for commercially available microprocessors, are generally known in the art. Such printed circuit boards house various integrated circuits for data message generation purposes, including signal multiplexers, digital to analog converters, programmable pulse generators as well as other circuits for controlling and/or programming parameters such as frequency, voltage levels, data bit numbers, etc. associated with a compatible computer with which the printed circuit board is interfaced. Typically the signal multiplexer circuit on such printed circuit boards are used as switches through which different input signals are selected and routed. As to the programmable pulse generators associated with such printed circuit boards, they are incapable of driving electrical loads as low as 50 ohms for operation between negative and positive voltages as high as 24 VDC.

At the present time, certain computer controlled equipment, such as missile weapons, are tested by equipment that is costly and of limited use. It is therefore an important object of the present invention to adapt a portable type of printed circuit board interlaced with a commercially available personal computer to generate programmed driving signals for testing of computer controlled equipment such as missiles in a less costly manner.

SUMMARY OF THE INVENTION

In accordance with the present invention, a printed circuit board is interfaced with a computer-controlled load to generate driving pulses corresponding to programmed digital input data signals that are convened into analog outputs in two channels fed to a signal multiplexer for mixing in order to produce a single channel bipolar output fed to voltage follower amplifiers. Such bipolar output is achieved by applying programmable positive and negative voltages to the multiplexer generated by two digital-to-analog converters. Operational control of the multiplexer is effected at its control pins by inputs accompanying the actual digital input data signals together with a timing clock signal for synchronization purposes. The presence of the clock signal at the control pins together with the programmable voltage levels at the data inputs of the multiplexer enables it to behave like a signal mixer to obtain the desired programming of the waveform characterizing the single channel bipolar output. Transmission of the digital input data is controlled by clock signals from a tinting control section, fed at selected voltage levels to two digital to analog converters through which the dual channel input to the signal multiplexer is achieved. Return of the amplified output of the multiplexer to the interfacing between the circuit board and the equipment load is controlled through programmed shift registers and relay control to differentially generate the driving pulses at relatively high voltage levels and within a relatively wide frequency range compatible with operation of the equipment load.

BRIEF DESCRIPTION OF DRAWING FIGURES

A more complete appreciation of the invention and many of its attendant advantages will be readily appreciated as the same becomes better understood by reference to the following detailed description when considered in connection with the accompanying drawing wherein.

DETAILED DESCRIPTION OF PREFERRED EMBODIMENT

Figure 1:
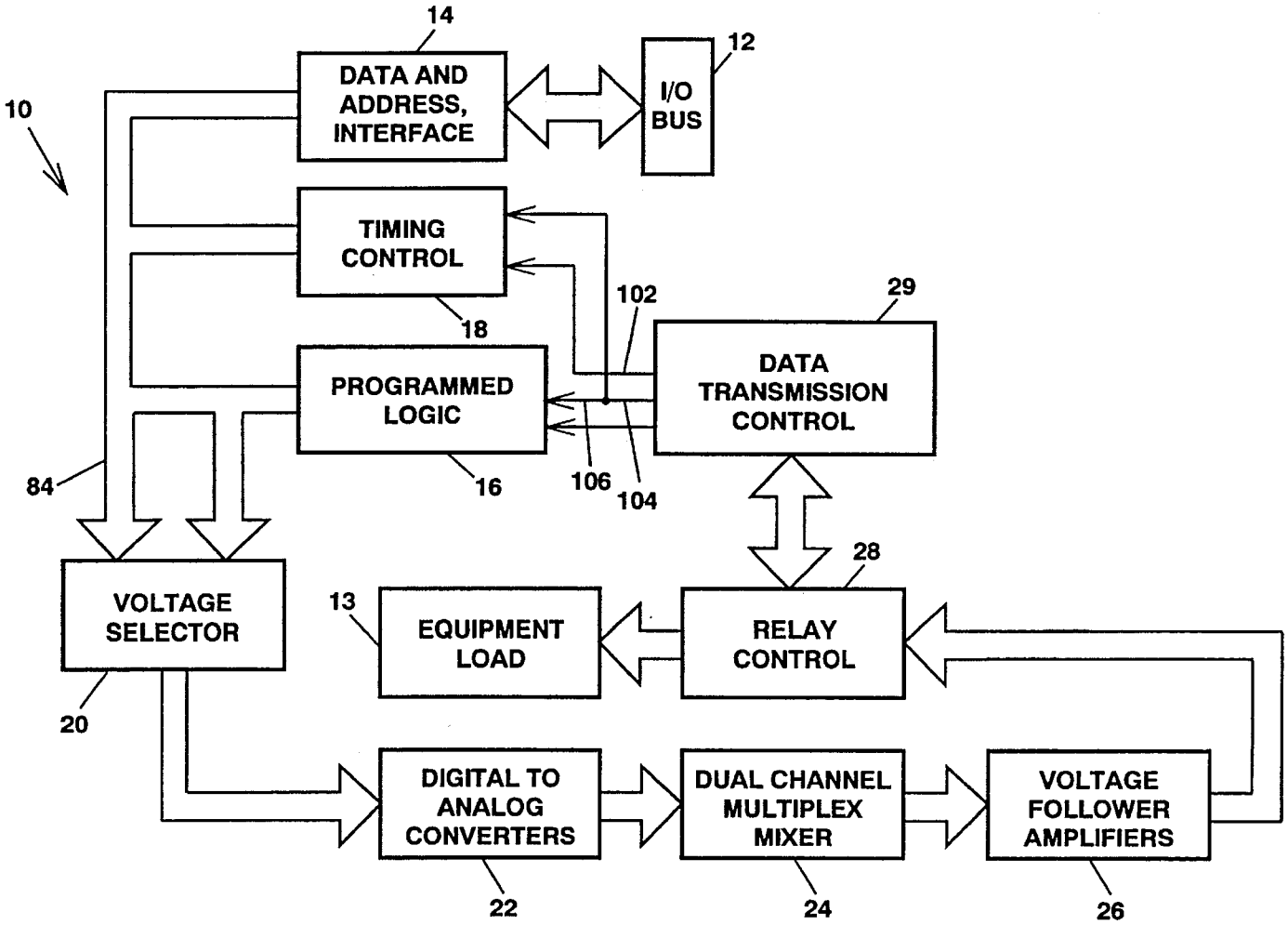
FIG. 1 is a block diagram depicting the data message generation system of the present invention in accordance with one embodiment thereof.

Referring now to the drawing in detail, FIG. 1 diagrams the message generation system of the present invention, generally referred to by reference numeral 10, adapted to be housed in a computer compatible printed circuit board having an input/output data bus 12 for testing and initializing equipment or loads 13 such as missile simulators or missile weapon systems operating at voltages above 15 VDC. The compatible printed circuit board with which the bus 12 is associated may be of a commercially available type for microprocessors, such as a full length 8-bit input/output mapped IBM XT/AT.

With continued reference to FIG. 1, the input/output data bus 12 is connected to a data and address interface section 14 of the system 10 through which data is decoded and a selected 8-bit address is driven for a 24-bit information write-in to a programmed logic section 16. The programmed logic section 16 is connected to a timing control section 18 for generation of a clock signal to set the speed and duration of digital data signals transmitted at selected voltage levels through a voltage selector section 20 to a dual channel digital-to-analog converter section 22. The processed digital message originating at the bus 12 is accordingly fed as analog outputs from the digital-to-analog converter section 22 to a multiplex mixer section 24 through which a programmed waveform signal is generated, completely different from the analog inputs thereto. The output of the mixer section 24 includes an initialization reset pulse, and is amplified within a voltage follower section 26 operatively interconnected with the voltage selector 20 under control of a relay section 28 connected to the load 13. Operational interaction between sections are furthermore under control of a data transmission control section 29 as diagrammed in FIG. 1.

Figure 2:
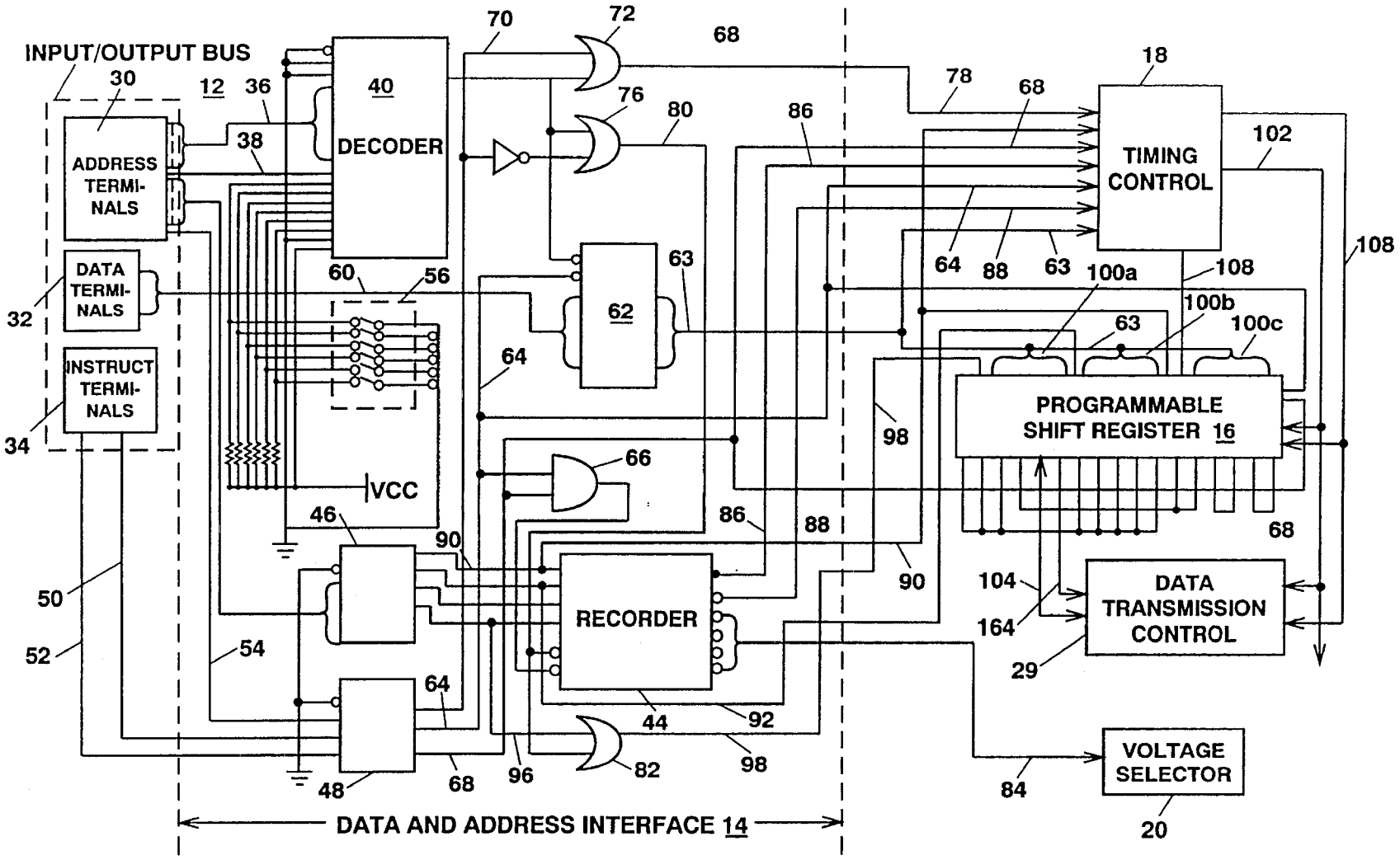
FIGS. 2–6 are more detailed circuit diagrams depicting the components of the system as depicted in FIG. 1.

As more specifically diagrammed in FIG. 2, the input/output data bus 12 includes address line terminals 30, data line terminals 32 and instruct line terminals 34, as well as power supply terminals VCC and ground terminals connected to various sections of the system 10 as hereinafter described and/or illustrated. Certain of the address terminals 30 are connected by bus line 36 and line 38 to an address decoding integrated circuit 40 while other address terminals are connected by address bus line 42 to another address decoding integrated circuit 44 through an address driving integrated circuit 46. Instruct lines 50 and 52 connected to the instruct terminals 34 of bus 12 are driven by integrated circuit 48 which is also connected to one of the address terminals 30 of the bus 12 by bus line 54 as shown.

In order to access the system 10 through the interface section 14, the address supplied through the input/output data bus 12 must match a selected address established through selector switch 56 connecting control terminals of the address decoding circuit 40 to grounded resistors 58. When a properly selected address is received at the input/output bus 12, the data signals in bus line 60 connected to the data terminals 32 drive the integrated circuit 62 to feed data signals through bus line 63 to logic and tinting control sections 16 and 18 pursuant to instructions supplied from the bus instruct terminals 34 through lines 50 and 52 connected to the circuit 48. In order to perform the instruction function, line 64 connects circuit 48 to data drive circuit 62 as well as to the timing control section 18, the programmed logic section 16 and one input terminal of AND gate 66. The other input terminal of AND gate 66 is connected to the circuit 48 by line 68 which is also connected to the programmed logic and timing sections 16 and 18. Yet another output of circuit 48 is connected by line 70 to one input of OR gate 72 and through amplifier 74 to one input of OR 76. The outputs of the OR gates 72 and 74 are respectively fed by lines 78 and 80 to the timing control section 18 and a control terminal of the address decoding circuit 44. The output of OR gate 76 is also connected to an input of OR gate 82. The decoded data output of the address decoding circuit 44 is fed by bus line 84 to the voltage selector section 20 while the other outputs of circuit 44 are fed by lines 86 and 88 to the timing control section 18. Data decoding operation of circuit 44 is furthermore governed by inputs received through lines 90, 92, 94 and 96 from the address driving circuit 46. Address driving signals in lines 90 and 92 are furthermore fed to the programmed logic section 16, while the output of OR gate 82 is fed thereto by line 98. The programmed logic and timing control sections 16 and 18 are also operatively interconnected by the data transmission control section 29, as diagrammed in FIG. 2, for interaction with the input/output bus 12 through the interface section 14 of the system 10. With continued reference to FIG. 2, the programmed logic section 16 is an array of programmable shift register devices forming integrated circuits which basically perform the function of a 24-bit bi-directional shift register. The logic section 16 accordingly includes three different 8-bit latch holding inputs 100*a*, 100*b* and 100*c* connected in parallel to the decoded data signal line 63 from the circuit 62 of the interface section 14. Data write-in to the logic section 16 is achieved through three latch inputs, selected by address signals in lines 90 and 92 from circuits 46 and 48 of the interface section 14 in accordance with internal decoding within the logic section 16 determined by the address settings of two of the address terminals 30 of the input/output bus 12. Once a 24-bit write-in occurs, a clock signal generated by the timing control section 18 is fed through line 102 to the logic section 16 causing it to shift bits to feed a data output through line 104 to the data transmission control section 29 for appropriate drive control. Such operation of the logic section 16 is controlled by internal counter/timers receiving clock signals through line 102 aforementioned, as well as address signals in line 98, instruct signals in line 68, enable signals in line 106 and clock signals in line 108.

Figure 3:
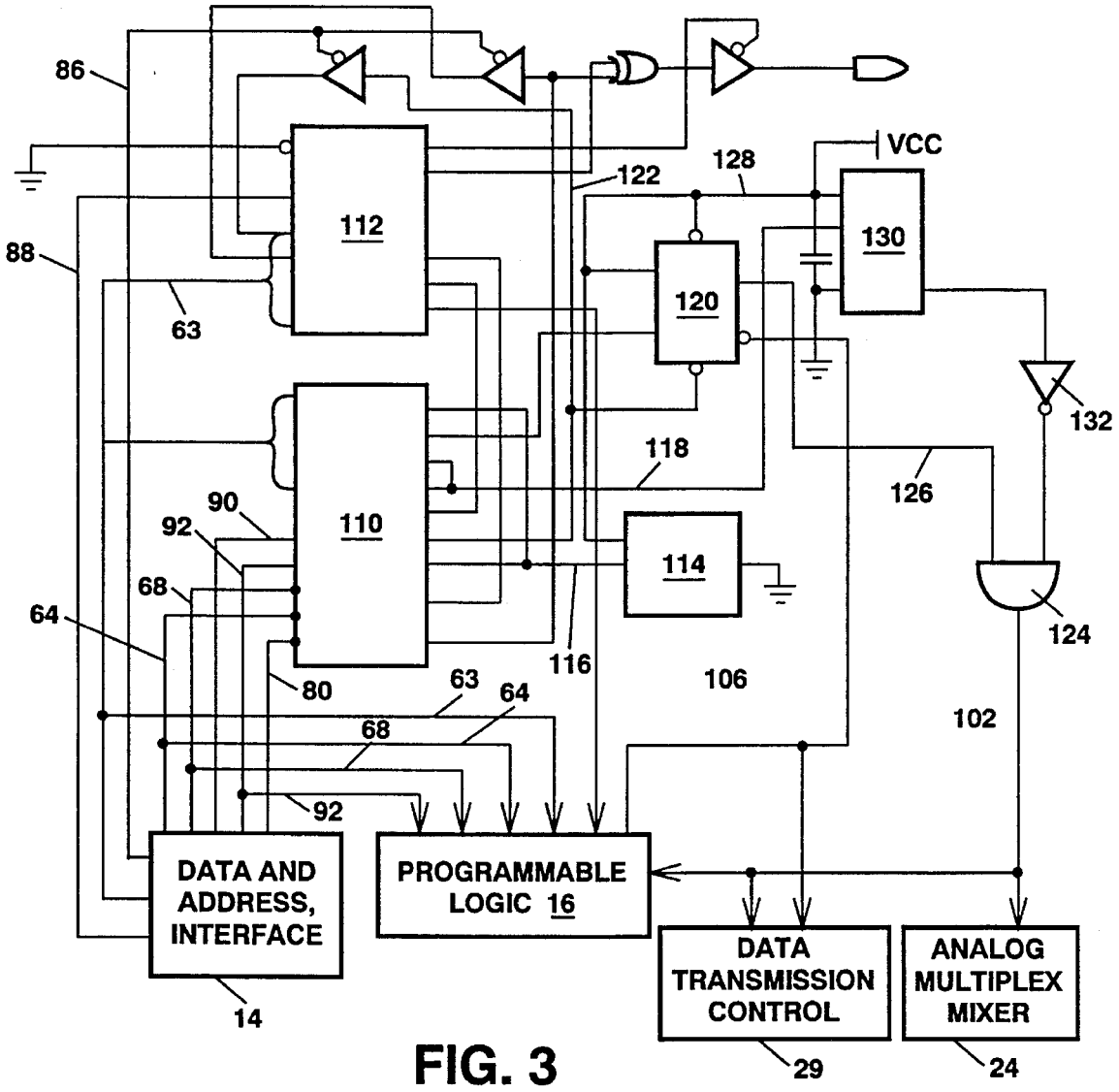

Referring now to FIG. 3, the timing control section 18 includes integrated circuits 110 and 112 to which the 8-bit data bus line 63 from the interface section 14 is connected. A 10 MHz clock 114 is connected by line 116 to two clock terminals of the circuit 110 in order to program selection of the frequency and duration of pulses generated at its output terminal to which line 118 is connected. The circuit 110 is also programmed to count a certain number of pulses, at which point it clears a flip-flop 120 through line 122 connecting circuit 110 to the clear terminal of flip-flop 120. When cleared, the flip-top 120 sets one input of AND gate 124 to logical zero through line 126 to automatically disable its transmission of a clock output to the logic section 16 through line 102. The clock output from AND gate 124 in line 102 is obtained from the clock signal generated by clock 114 and transmitted therefrom by line 128 through delay circuit 130 and inverter 132 to the other input of AND gate 124. The delay circuit 130 and inverter 132 compensate for the timing delays of circuit 130 in counting the corresponding number of bits and the flip-flop 120 in clearing its output in line 126 to the AND gate 124.

Figure 4:
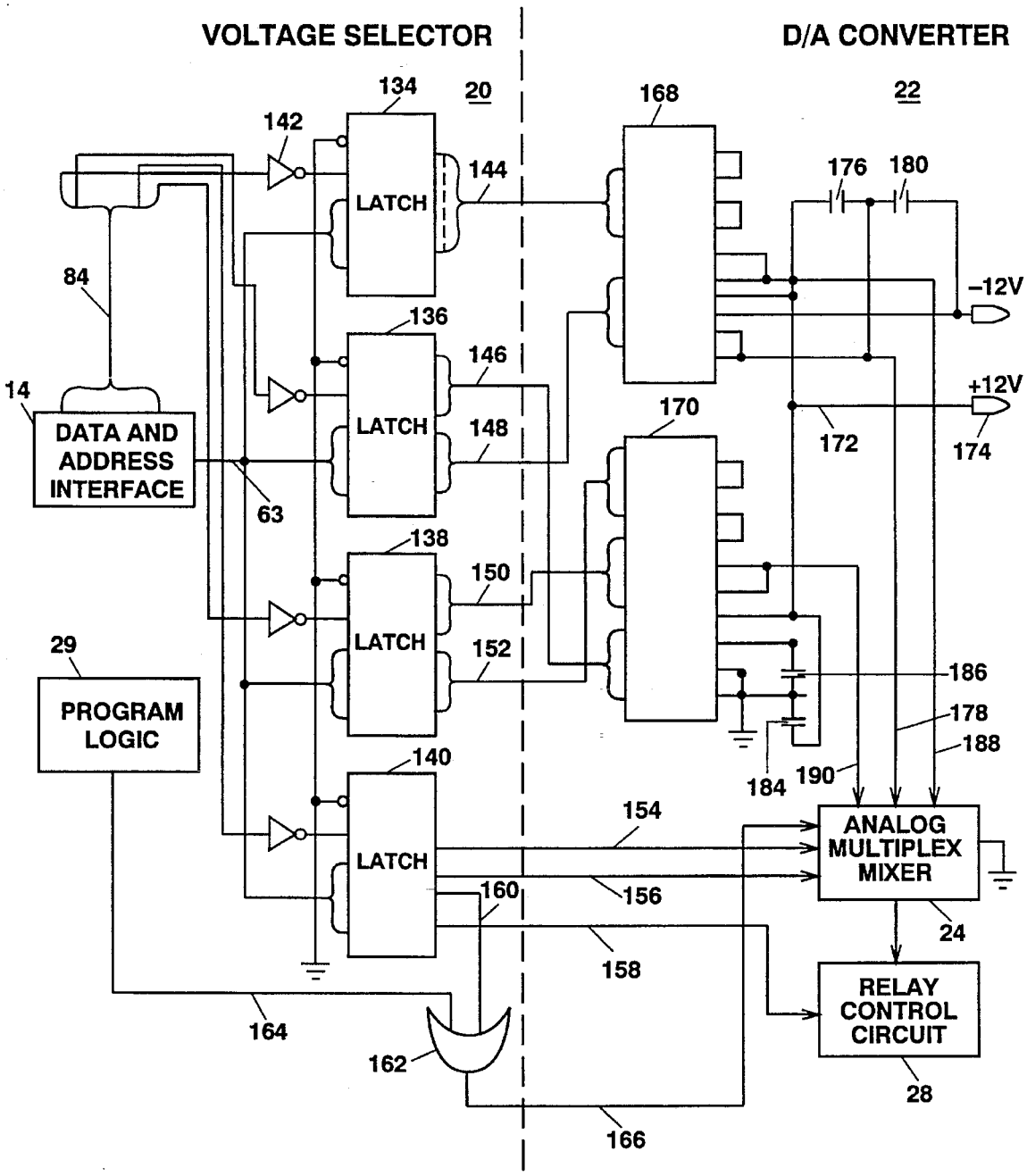

As hereinbefore indicated, the digital outputs 84 of the interface section 14 is fed to the voltage selector section 20 having inverters 142 supplying such outputs to control inputs of latch circuits 134, 136, 138 and 140 as shown in FIG. 4. Three of the latch circuits 134, 136 and 138 thereby select the voltages in the data signal lines 63 from the interface section 14, that are fed to the digital-to-analog converter section 22 through an 8-bit digital output bus line 144 from latch circuit 134, two 4-bit digital output bus lines 146 and 148 from latch circuit 136 and two 4-bit digital output bus lines 150 and 152 from latch circuit 138. The fourth latch circuit 140 supplies two voltage outputs in lines 154 and 156 to the analog multiplex mixer section 24, a voltage output in line 158 to the relay control circuit 28 and a fourth voltage output in line 160 to one input of OR gate 162 receiving its other input in line 164 from a data output terminal of the programmed logic 16. The OR gate 162 thereby controls operation of the analog multiplex mixer 24 through output line 166 from the OR gate 162.

The digital-to-analog converter section 22 includes converter circuits 168 and 170 to which 8-bit voltage selector signals are fed by 8-bit bus line 144 and 4-bit bus lines 146, 148, 150 and 152 from the voltage selector section 20 as shown in FIG. 4. The converter circuits 168 and 170 are powered by connection through line 172 to a positive 12-volt source 174 also coupled to the mixer section 24 by capacitor 176 and line 178 separated by capacitor 180 from a negative 12-volt source 182. The +12-volt line 172 is also coupled by capacitor 184 to grounded terminals of converter circuit 170 and to another terminal thereof through capacitor 186. Yet two other analog output terminals of converter circuits 168 and 170 are respectively connected by lines 188 and 190 to the mixer section 24, as diagrammed in FIG. 4, to respectively supply negative and positive message pulses to the mixer section 24.

Figure 5:
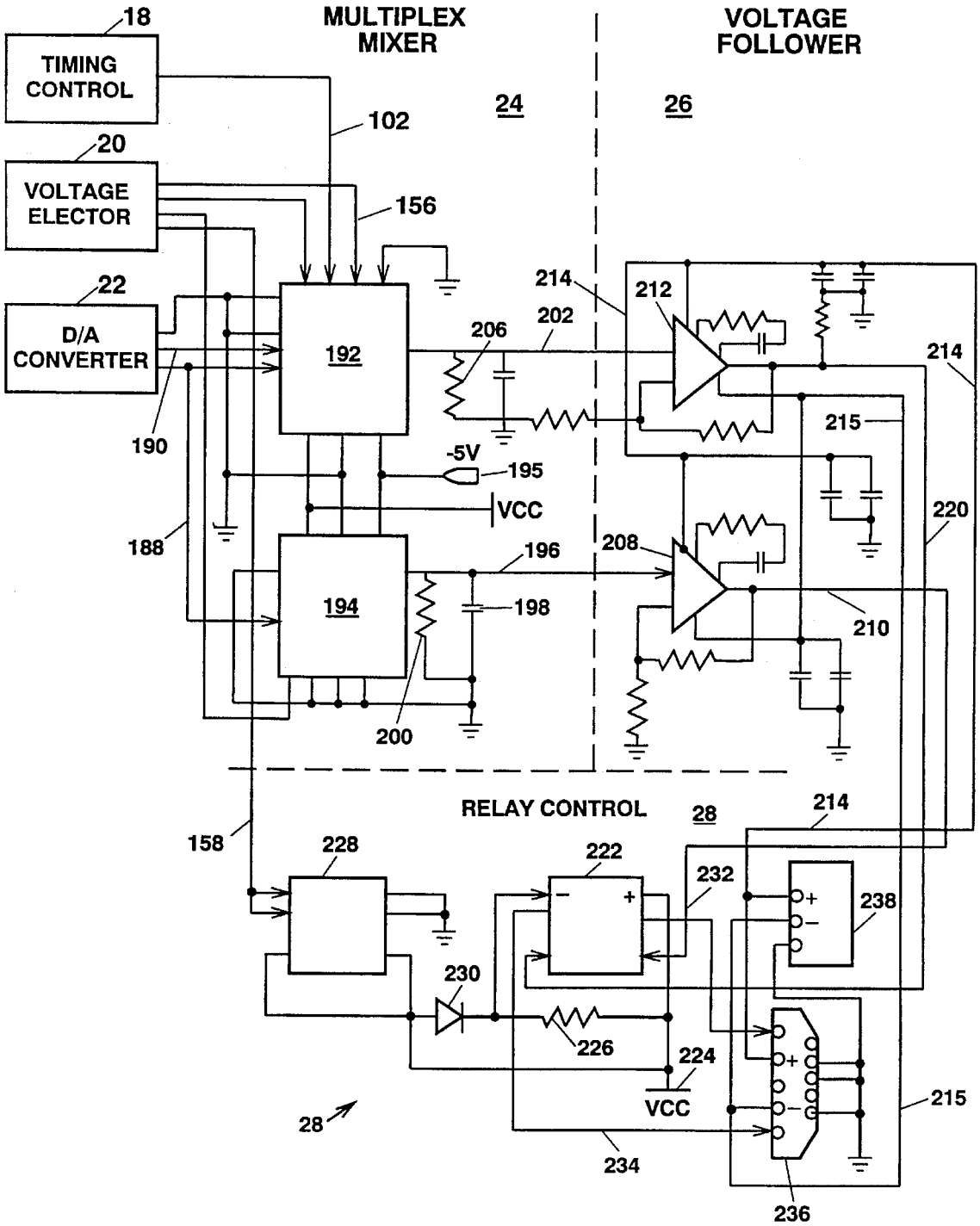

As diagrammed in FIG. 5, the mixer section 24 includes two analog multiplexer circuits 192 and 194 interconnected in parallel to voltage supply VCC, to ground and to a negative 5-volt source 195. Analog message pulses of opposite polarity from the converter section 22 are respectively supplied through lines 188 and 190 to input terminals of multiplex circuit 192. Output voltage pulses in line 188 are also fed to an input terminal of multiplex circuit 194 which switches between the voltage supplied thereto and ground in order to generate reset pulses in its output signal line 196, coupled to ground through capacitor 198 in parallel with resistor 200. Clock generated timing signals from the timing control section 18 in line 102 and data signals in line 166 from the voltage selector section 20, on the other hand, are fed to the multiplexer circuit 192 to generate pulses in its output signal line 202 coupled by parallel connected capacitor 204 and resistor 206 to ground.

Figure 7:
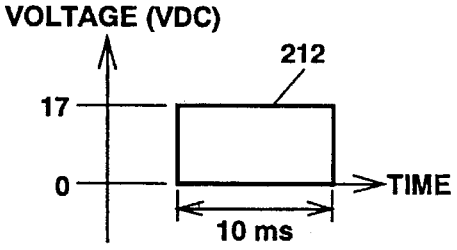
FIGS. 7, 8 and 9 graphically depict various signal formats associated with operation of the system depicted in FIGS. 1–6.
Figure 8:
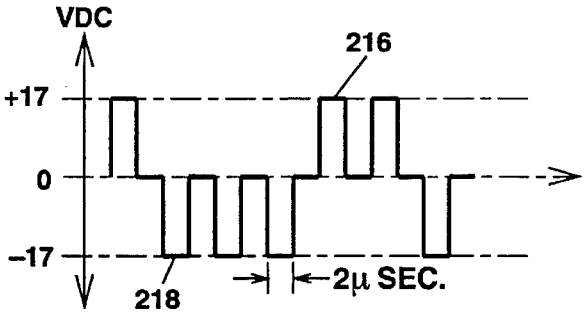

With continued reference to FIG. 5, the reset pulse generated by the switching action of multiplexer circuit 194 as hereinbefore described, is fed by line 196 to an output driving amplifier 208 of the voltage follower amplifier section 26 for amplification by a factor of five to provide in line 210 an initialization reset pulse 212 between 0 VDC and +17 VDC as graphically depicted in FIG. 7. The pulse output generated by the mixing action of multiplexer circuit 192, on the other hand, is fed by line 202 to an output amplifier 212 interconnected with amplifier 208 by control electrode lines 214 and 215 to produce a string of time controlled pulses 216 of 2 μsec duration at voltage levels of +17 VDC and off-time pulses 218 at levels of −17 VDC as graphically depicted in FIG. 8. Such pulse output of amplifier 212 in line 220 as well as the pulse output of amplifier 208 in line 214 and the control line 214 interconnecting the amplifiers 208 and 214 are connected to the relay control section 28 for operational regulation purposes. As diagrammed in FIG. 5, the pulse output line 210 from the amplifier 208 of the voltage follower section 26 is connected to an input terminal of an integrated relay circuit 222 having a positive voltage terminal connected to a voltage source 224 and separated by resistor 224 from the negative voltage terminal of circuit 222 to which two terminals of an integrated voltage control circuit 228 are coupled by diode 230. The input terminals of circuit 228 receive a voltage output in line 158 from the voltage selector 20, as hereinbefore indicated, to establish the proper operational voltage level for relay circuit 222 through diode 230. The pulse output of the follower amplifier 212 in line 220 is fed to another input terminal of relay circuit 222, having command output terminals respectively connected by lines 232 and 234 to a multi-pin connector 236 having positive and negative voltage terminals connected in parallel with the voltage control circuit 238 to establish voltage levels of +28 V and −28 V in electrode control lines 214 and 215 connected to the follower amplifiers 208 and 212 as aforementioned.

Figure 6:
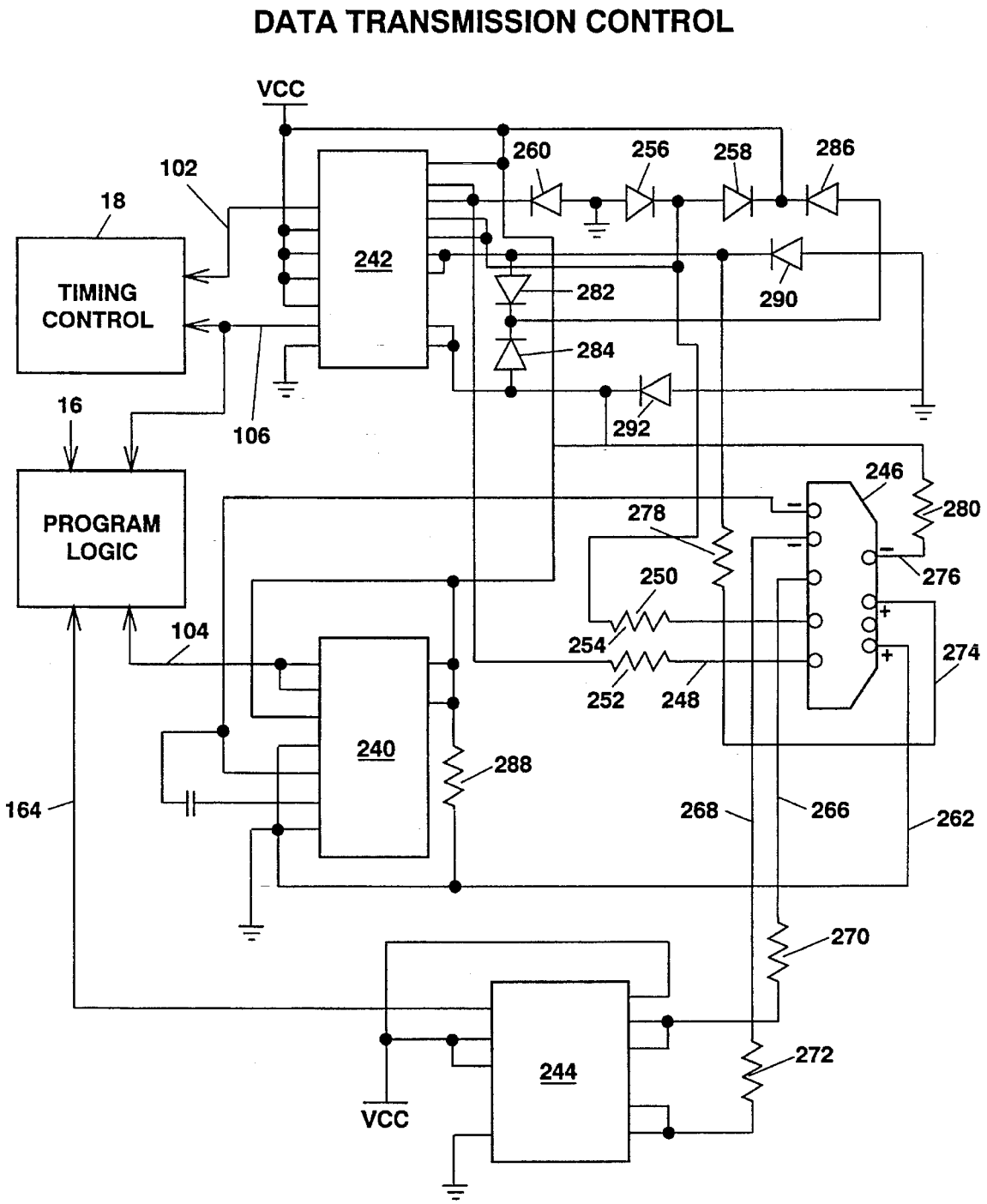

The data input and output control section 29 as diagrammed in FIG. 6, includes three integrated circuits 240, 242 and 244. A clock drive signal in line 102 is thus fed to the timing control section 18 from one terminal of circuit 242 having another terminal from which a data enable signal is fed by line 106 to the timing control section 18. Data output signals in line 164 to the programmed logic section 16 are fed thereto from circuit 240 while data input signals are fed through line 104 to the logic section 16 from circuit 244. The circuits 240, 242 and 244 are operatively interconnected directly with each other and/or through resistors, diodes and multi-pin connector 246, as diagrammed in FIG. 6 for differential message drive of the four lines 102, 104, 106 and 164 from the circuits 240, 242 and 244 to the timing control section 18 and programmed logic section 16. Thus, the pin connector 246 has one set of positive clock and negative clock return terminals connected to lines 248 and 250 respectively coupled by resistor 252 to a pair of terminals of circuit 242 and by resistor 254 to a juncture between series connected diodes 256 and 258. Such diode juncture is connected to another pair of terminals of circuit 242, while the first pair of aforementioned clock terminals are also connected to diode 260 grounded with diode 256. A second set of positive data-in and negative data-in return terminals of the pin connector 246 are respectively connected by lines 262 and 264 to separate terminals of the circuit 240. A third set of positive data-out and negative data-out return terminals are respectively connected by lines 266 and 268 through resistors 270 and 272 to two pairs of terminals of the circuit 244. Finally, a fourth set of positive data-enable and negative data-enable return terminals of the pin connector 246 are respectively connected by lines 274 and 276 through resistors 278 and 280 to two pairs of terminals of circuit 242. The latter two pairs of circuit terminals are interconnected through opposing diodes 282 and 284 having a juncture connected through diode 286 to the voltage source VCC to which diode 258 is also connected as well three terminals of circuit 240 separated from line 262 by resistor 288. The two pairs of data-enable terminals of circuit 242 to which resistors 278 and 280 are connected are also connected to ground through diodes 290 and 292 as diagrammed in FIG. 6.

Figure 9:
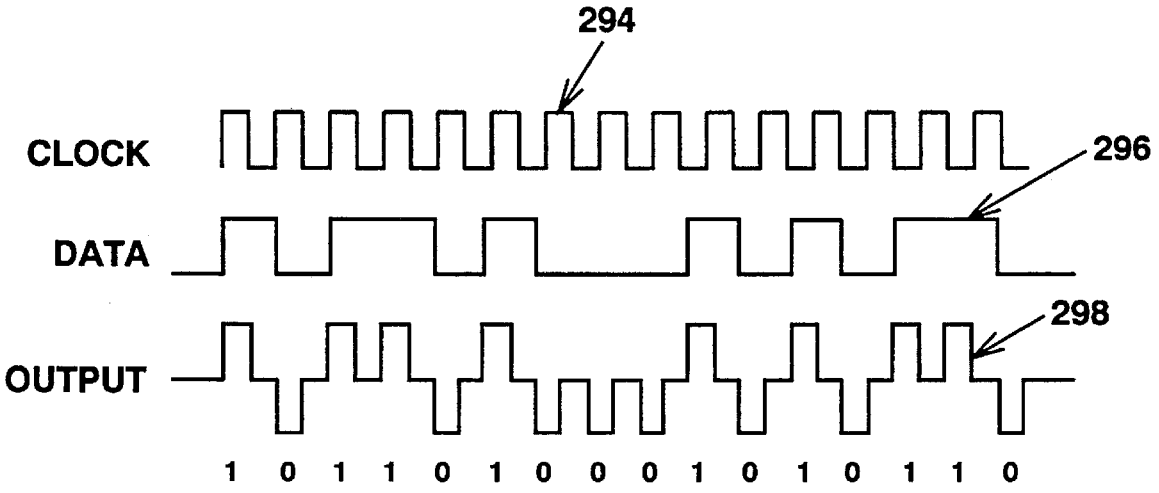

Based on the foregoing description of the illustrated circuit diagrams, a digital clock signal 294 as graphically depicted in FIG. 9 is produced by the timing control section 18 to affect transmission of digital data signals 296, governed by the programmed logic section 16 and fed to the voltage selector section 20 from which a pulse type message data output 298 is generated from voltage outputs of the digital to analog converter section 22 and fed to the multiplex mixer section 24 within which such data is mixed with computer controlled voltage level pulses. A signal pulse output is thereby obtained from mixer section 24 and amplified in voltage follower section 26 for driving high resistive loads through the interface section 14 and bus 12, such as 50 ohm communication lines to equipment 13 operating at voltage levels greater than 15 VDC and within a wide frequency range between 0 and 300 KHz.

Obviously, other modifications and variations of the present invention may be possible in light of the foregoing teachings. It is therefore to be understood that within the scope of the appended claims the invention may be practiced otherwise than as specifically described.

What is claimed is:

1. In a computer controlled message generation system having signal multiplexer means interfaced with a load for operation thereof in response to input data signals, the improvement residing in: signal converter means connected to data inputs of the signal multiplexer means for supply of the input data signals thereto at programmed voltage levels; timing means connected to the signal multiplexer means for controlling generation of an output signal therefrom by mixing of said input data signals; and programmed data transmission means operatively connecting the signal multiplexer means to the load for supplying driving signals thereto as a function of the output signal above a predetermined voltage level and within a predetermined frequency range.

2. The improvement as defined in claim 1 wherein said signal converter means comprises a pair of digital-to-analog converters from which the input data signals are transmitted to the signal multiplexer means for said mixing thereof therein.

3. The improvement as defined in claim 2 wherein said programmed data transmission means includes four signal lines through which clock, data-in, data-out and data-enable functions are respectively performed by the driving signals differentially generated to establish said predetermined voltage level within said predetermined frequency range as 0 to 300 KHz.

4. The improvement as defined in claim 1 wherein said programmed data transmission means includes four signal lines through which clock, data-in, data-out and data-enable functions are respectively performed by the driving signals differentially generated to establish said predetermined voltage level within said predetermined frequency range as 0 to 300 KHz.

5. In a computer controlled message generation system having signal multiplexer means, the improvement residing in: signal converter means connected to data inputs of the signal multiplexer means for supply of input data signals thereto at programmed voltage levels through two channels: timing means connected to control pins of the signal multiplexer means for controlling generation of a bipolar output signal therefrom by mixing of said input data signals respectively received through said two channels; and programmed data transmission means operatively connected to the signal multiplexer means for supplying driving signals as a function of the bipolar output signal.

6. The improvement as defined in claim 5 wherein said programmed data transmission means includes means for differentially generating the driving signals in response to the output signal from the signal multiplexer means.

7. The improvement as defined in claim 6 wherein the driving signals consist of clock, data-in, data-out and data-enable outputs.

8. The improvement as defined in claim 5, including voltage follower amplifier means to which the bipolar output signal is transmitted from the multiplexer means for controlling said generation of the driving signals to operate loads as low as 50 ohms.

* * * * *